US008789627B1

(12) United States Patent
Sani et al.

(10) Patent No.: US 8,789,627 B1
(45) Date of Patent: Jul. 29, 2014

(54) POLYCRYSTALLINE DIAMOND CUTTER WITH IMPROVED ABRASION AND IMPACT RESISTANCE AND METHOD OF MAKING THE SAME

(75) Inventors: Mohammad Sani, Orem, UT (US); Ken Bertagnolli, Sandy, UT (US); Eric Pope, Provo, UT (US)

(73) Assignee: US Synthetic Corporation, Orem, UT (US)

( * ) Notice: Subject to any disclaimer, the term of this patent is extended or adjusted under 35 U.S.C. 154(b) by 303 days.

(21) Appl. No.: 11/183,366

(22) Filed: Jul. 17, 2005

(51) Int. Cl.
*E21B 10/46* (2006.01)

(52) U.S. Cl.
USPC ..... 175/434

(58) Field of Classification Search
USPC ..... 175/434, 420.2; 428/408; 407/119
See application file for complete search history.

(56) References Cited

U.S. PATENT DOCUMENTS

| | | | | |
|---|---|---|---|---|
| 3,745,623 | A | 7/1973 | Wentorf, Jr. et al. | 29/95 B |
| 4,311,490 | A | 1/1982 | Bovenkerk et al. | 51/307 |
| 4,403,015 | A | 9/1983 | Nakai et al. | 428/565 |
| 4,525,178 | A | 6/1985 | Hall | 51/309 |
| 4,527,998 | A | 7/1985 | Knemeyer | 51/309 |
| 4,539,018 | A | 9/1985 | Whanger et al. | 51/295 |
| 4,592,433 | A | 6/1986 | Dennis | 175/329 |
| 4,604,106 | A | 8/1986 | Hall et al. | 51/293 |
| 4,694,918 | A | 9/1987 | Hall | 175/329 |
| 4,772,294 | A | 9/1988 | Schroeder | 51/309 |
| 4,776,861 | A | 10/1988 | Frushour | 51/293 |
| 4,797,241 | A | 1/1989 | Peterson et al. | 264/63 |
| 4,861,350 | A | 8/1989 | Phaal et al. | 51/307 |
| 4,866,885 | A | 9/1989 | Dodsworth | 51/293 |
| 4,941,891 | A | 7/1990 | Tank et al. | 51/293 |
| 4,944,772 | A | 7/1990 | Cho | 51/293 |
| 4,959,929 | A | 10/1990 | Burnand et al. | 51/307 |
| 5,011,514 | A | 4/1991 | Cho et al. | |
| 5,028,177 | A * | 7/1991 | Meskin et al. | 408/145 |
| 5,127,923 | A | 7/1992 | Bunting et al. | 51/293 |
| 5,135,061 | A | 8/1992 | Newton, Jr. | 175/428 |
| 5,199,832 | A * | 4/1993 | Meskin et al. | 408/145 |
| 5,205,684 | A * | 4/1993 | Meskin et al. | 408/145 |
| 5,238,074 | A | 8/1993 | Tibbitts et al. | 175/428 |
| 5,304,342 | A | 4/1994 | Hall, Jr. et al. | 419/11 |
| 5,370,195 | A | 12/1994 | Keshavan et al. | 175/420.2 |
| 5,370,717 | A | 12/1994 | Lloyd et al. | 51/293 |
| 5,384,470 | A | 1/1995 | Tachibana et al. | 257/77 |
| 5,443,337 | A * | 8/1995 | Katayama | 408/145 |
| 5,468,268 | A | 11/1995 | Tank et al. | 51/293 |
| 5,469,927 | A | 11/1995 | Griffin | 175/432 |
| 5,505,748 | A | 4/1996 | Tank et al. | 51/293 |
| 5,510,193 | A | 4/1996 | Cerutti et al. | 428/552 |
| 5,611,251 | A * | 3/1997 | Katayama | 76/108.6 |
| 5,645,617 | A | 7/1997 | Frushour | 51/309 |

(Continued)

FOREIGN PATENT DOCUMENTS

| | | |
|---|---|---|
| WO | WO 02/34437 | 5/2002 |

*Primary Examiner* — David Andrews
(74) *Attorney, Agent, or Firm* — Holland & Hart, LLP

(57) ABSTRACT

Disclosed are a high impact/high abrasion cutter and a method for manufacture. The high impact/high abrasion cutter includes a plurality of preformed polycrystalline abrasive bodies sintered under high temperature/high pressure conditions to form an abrasive cutting table. The impact and abrasion resistance of a cutter can simultaneously be improved through forming a cutting table from larger preformed polycrystalline sintered particles formed from finer grain particles. Such a cutter can be manufactured through the steps of preforming the polycrystalline abrasive bodies, forming a mixture of said polycrystalline abrasive bodies and sintering said mixture under high temperature/high pressure conditions.

22 Claims, 2 Drawing Sheets

(56) References Cited

U.S. PATENT DOCUMENTS

| | | | | |
|---|---|---|---|---|
| 5,711,702 | A | 1/1998 | Devlin | 451/540 |
| 5,766,394 | A | 6/1998 | Anderson et al. | 156/89.11 |
| 5,848,348 | A | 12/1998 | Dennis | 419/5 |
| 5,855,996 | A | 1/1999 | Corrigan et al. | 428/212 |
| 5,871,060 | A | 2/1999 | Jensen et al. | 175/420.2 |
| 5,890,552 | A | 4/1999 | Scott et al. | 175/426 |
| 6,011,248 | A | 1/2000 | Dennis | 219/700 |
| 6,063,333 | A | 5/2000 | Dennis | 419/6 |
| 6,063,502 | A | 5/2000 | Sue et al. | 428/469 |
| 6,068,071 | A | 5/2000 | Jurewicz | 175/432 |
| 6,068,913 | A | 5/2000 | Cho et al. | 428/212 |
| 6,098,731 | A | 8/2000 | Chow et al. | 175/434 |
| 6,102,140 | A | 8/2000 | Boyce et al. | 175/374 |
| 6,106,957 | A | 8/2000 | Fang | 428/545 |
| 6,179,886 | B1 | 1/2001 | Gordeev et al. | 51/293 |
| 6,187,068 | B1 | 2/2001 | Frushour et al. | 51/295 |
| 6,189,634 | B1 | 2/2001 | Bertagnolli et al. | 175/432 |
| 6,248,447 | B1 | 6/2001 | Griffin et al. | 428/408 |
| 6,319,460 | B1 | 11/2001 | Fang | 419/32 |
| 6,325,165 | B1 | 12/2001 | Eyre | 175/426 |
| 6,361,873 | B1 | 3/2002 | Yong et al. | 428/469 |
| 6,372,012 | B1 * | 4/2002 | Majagi et al. | 75/236 |
| 6,410,085 | B1 | 6/2002 | Griffin et al. | 427/247.7 |
| 6,451,442 | B1 | 9/2002 | Sue et al. | 428/469 |
| 6,454,027 | B1 | 9/2002 | Fang et al. | 175/374 |
| 6,454,077 | B2 | 9/2002 | Nimmo et al. | 193/37 |
| 6,544,308 | B2 | 4/2003 | Griffin et al. | 51/309 |
| 6,562,462 | B2 | 5/2003 | Griffin et al. | 428/408 |
| 6,585,064 | B2 | 7/2003 | Griffin et al. | 175/434 |
| 6,589,640 | B2 | 7/2003 | Griffin et al. | 428/212 |
| 6,592,985 | B2 | 7/2003 | Griffin et al. | 428/332 |
| 6,601,662 | B2 | 8/2003 | Matthias et al. | 175/374 |
| 6,607,835 | B2 | 8/2003 | Fang et al. | 428/469 |
| 6,852,414 | B1 * | 2/2005 | Frushour | 428/408 |
| 2003/0024351 | A1 | 2/2003 | Pender et al. | |
| 2006/0081402 | A1 * | 4/2006 | Lockwood et al. | 175/374 |
| 2007/0054101 | A1 | 3/2007 | Sigalas et al. | |

* cited by examiner

POLYCRYSTALLINE DIAMOND CUTTER WITH IMPROVED ABRASION AND IMPACT RESISTANCE AND METHOD OF MAKING THE SAME

BACKGROUND OF INVENTION

1. Field of the Invention

This invention relates to polycrystalline diamond (PCD) cutters used primarily in the oil and gas industry for drilling. More specifically, this invention relates to polycrystalline diamond cutting tools and a method for manufacture thereof that includes high abrasion and high impact preformed superhard/superabrasive features that improve the abrasion and impact resistance of a PCD cutter.

2. Description of Related Art

Polycrystalline diamond (PCD) cutters often form the cutting structure of down hole tools, including drill bits (fixed cutter, rollercone and percussion bits) reamers, and stabilizers in the oil and gas industry. A variety of PCD devices, specifically diamond cutting surfaces that include different diamond compositions, diamond layers, and diamond blends or combinations thereof have been described and are well known in the art. Generally, the prior art devices do not have diamond tables comprising a plurality of preformed superhard/superabrasive bodies simultaneously improving the impact and abrasion resistance of a PCD cutter.

A polycrystalline diamond cutter can be manufactured by number of methods of which are well known in the art. The process includes preparation of the diamond particles. The diamond particles are selected based on the desired cutter properties. It is well known in the PCD industry that impact and abrasion resistance are inversely proportionally related. Generally, when abrasion resistance increases impact resistance drops. Traditionally impact and abrasion resistance have been controlled through varying the diamond grain size. Large grain particles tend to produce a high impact cutter while small grain particles result in a high abrasion cutter. More recently PCD manufacturers have controlled impact and abrasion resistance through varying different diamond properties including hardness, metal content, and thermal stability. Other means for tailoring the impact and abrasion resistance include multi-modal diamond mixes, multi-grade diamond layers and metal/diamond composite structures. The PCD manufacturing process further includes loading the predetermined diamond crystal composition adjacent a substrate in a refractory metal can. A back can is then positioned over the substrate to form a can assembly. The can assembly is placed into a cell made of an extrudable material such as pyrophyllite or talc. The cell is subjected to conditions necessary for diamond-to-diamond bonding or sintering conditions in a high pressure/high temperature press.

PCD's are conventionally manufactured using a sintered catalytic elemental material, typically selected from cobalt and other iron group materials and alloys, which act as catalysts for the transformation of graphite to diamond. These materials are generally selected from Group VIII elements, namely Fe, Co, Ni, Ru, Rh, Pd, Os, Ir, and P; Transition metals, namely Mn, Cr and Ta; and Carbide formers from Groups IVB, VB, VIB, namely Ti, Zr, Hf, V, Nb, Mo and W, alloyed with Group IB materials, namely Cu, Ag and Au.

This detail is given in order to generally familiarize the reader with PCD sintering technology. For more information regarding the manufacture of PCD cutters the reader is referred to U.S. Pat. No. 3,745,623.

There are a variety of U.S. patent documents that are helpful in providing the reader with general background information regarding PCD cutter design and manufacture. The reader is referred to the following U.S. patents of which are hereby incorporated by reference in their entirety for the material contained therein.

U.S. Pat. No. 4,311,490 discloses and claims a cutter wherein a mass of abrasive crystals are disposed in layers. The coarsest layer is closest to the carbide mass and is composed of crystals having a largest dimension of between about 75 and 500 microns and the finest layer is disposed farthest away in the carbide mass and is composed of crystals having a largest dimension of less than 10 microns.

U.S. Pat. No. 4,403,015 discloses a cutting tool having particularly high properties in respect of bonded strength, hardness, wear resistance, plastic deformability and rigidity by bonding a diamond or cubic boron nitride containing hard layer to a cemented carbide substrate with interposition of an intermediate bonding layer comprising cubic boron and a compound selected from among carbides, nitrides, carbonitrides or borides of 4*a*, 5*a*, 6*a* transition metals of the periodic table.

U.S. Pat. No. 4,539,018 describes a method for fabricating cutter elements for a drill bit.

U.S. Pat. No. 4,525,178 discloses and claims a composite material which includes a mixture of individual diamond crystals and pieces of precemented carbide. The mixture is heated and pressurized to create intercrystalline bonds between the diamond crystals and chemical bonds between the diamond crystals and the precemented carbide pieces. The resulting composite polycrystalline diamond body exhibits excellent wear characteristics and impact resistance.

U.S. Pat. Nos. 4,527,998 and 4,772,294 describe an implement that comprises a cemented carbide supported composite abrasive compact, which is brazed to a cemented carbide substrate with a brazing filler metal having a liquidus substantially above 700 degrees C.

U.S. Pat. No. 4,592,433 discloses a cutting blank, preferably for use on a drill bit for cutting through earth formations, comprising a substrate formed of a hard material and a cutting surface. A plurality of shallow grooves are formed in the cutting surface. Strips of a diamond substance are disposed in the grooves.

U.S. Pat. No. 4,604,106 discloses a composite polycrystalline diamond compact comprising at least one layer of diamond crystals and precemented carbide pieces which have been pressed under sufficient heat and pressure to create a composite polycrystalline material wherein the polycrystalline diamond and the precemented carbide pieces are interspersed in one another.

U.S. Pat. No. 4,694,918 discloses percussion and rock bit inserts having at least two layers on the protruding drilling portion of the insert. The outermost layer contains polycrystalline diamond. The remaining layers adjacent the polycrystalline diamond layer are transition layers containing a composite of diamond crystals and precemented tungsten carbide, the composite having a higher diamond crystal content adjacent the polycrystalline diamond layer and a higher precemented tungsten carbide content adjacent the tungsten carbide layer.

U.S. Pat. No. 4,776,861 discloses diamond or CBN polycrystalline abrasive grit useful in tools for grinding or cutting produced by size reducing and leaching non-diamond or non-CBN material from a compact greater than 1,000 microns in diameter to provide polycrystalline abrasive grit having a size of from about 1 to about 1,000 microns in diameter and having a network of inter-connected, empty pores dispersed throughout.

U.S. Pat. No. 4,797,241 discloses a method for producing multiple polycrystalline diamond and/or CBN bodies. The method involves mixing a temporary binding agent, such as paraffin, with a quantity of the crystals and then molding or extruding that mixture to produce temporarily held bodies. The temporarily held bodies are then placed in a reaction chamber and surrounded by a pressure transmitting medium, such as powdered cemented tungsten carbide. The reaction chamber is then pressed and heated thereby creating discrete polycrystalline diamond and/or CBN bodies of approximately the same shape and size as the temporarily held bodies.

U.S. Pat. No. 4,861,350 discloses a layered PCD cutter with fine diamond at the working surface and coarse diamond at the interface. It further discloses that the top layer be less than 75 micron and the bottom layer be greater than 100 microns. The patent also discloses the bottom layer including carbide particles to form a type of transition layer.

U.S. Pat. No. 4,866,885 discloses a method for producing a composite abrasive compact including placing strips of suitable abrasive material on a cemented carbide substrate. The strips each comprise abrasive particles, optionally with a particulate second phase, in an organic binder. The organic binder is first removed by volatilization. Then, the cemented carbide substrate with the strips thereon is subjected to compact-producing conditions of elevated temperature and pressure producing a cutter with alternating strips of diamond.

U.S. Pat. No. 4,941,891 describes a tool component, which comprises an abrasive compact bonded to a cemented carbide support body. The abrasive compact has two zones which are joined by an interlocking common boundary.

U.S. Pat. No. 4,944,772 discloses a process for fabricating a supported polycrystalline diamond or CBN bi-layer compact which comprises forming a sintered polycrystalline or CBN compact which preferably is a thermally-stable compact. A cemented carbide support is separately formed. The compact and the support then are mated with a layer of diamond or CBN crystals having the largest dimension of between about 30 and 500 micrometers interposed there between. A source of catalyst/sintering aid material is provided in association with the layer of interposed crystals. The entire assembly then is subjected to HP/HT conditions and for a time adequate for converting the diamond or CBN crystals into a polycrystalline diamond or CBN layer producing a bi-layer supported compact.

U.S. Pat. No. 4,959,929 discloses and claims a tool insert comprising a composite diamond abrasive compact and a method of its production. The composite abrasive compact is characterized by an intermediate layer between the diamond compact and the cemented carbide support. The intermediate layer consists essentially of discrete CBN particles constituting 60 to 40 percent by volume of the intermediate layer, carbide particles, preferably tungsten carbide particles and diamond solvent, preferably cobalt.

U.S. Pat. No. 5,028,177 discloses a diamond cutter for use in a drill bit having a geometric size and shape normally characterized by an un-leached diamond product, such as STRATAPAX diamond cutters that can be fabricated by assembling a plurality of prefabricated leached polycrystalline diamond (PCD) elements in an array in a cutting slug. The cutting face of the cutting slug is characterized by exposing at least one surface of each of the PCD elements disposed therein. The diamonds may be set within the cutting slug either in a compact touching array or in a spaced-apart relationship. The PCD elements can assume a variety of polyhedral shapes such as triangular prismatic elements, rectangular elements, hexagonal elements and the like. The plurality of diamond elements and the cutting slug are fabricated using hot pressing or infiltration techniques.

U.S. Pat. No. 5,127,923 discloses an abrasive compact and a method for making the same with a substantially solid body from a mass of abrasive particles which are bonded together on a particle-to-particle basis. A network of interstices is formed within the body by removing the metallic second phase by-product of a solvent catalyst sintering aid. The network of interstices is filled with the carbide by product of a non-catalyst sintering aid forming a solid body. A substrate is bonded to some of the particles and to some of the carbide filling the network of interstices.

U.S. Pat. No. 5,135,061 discloses a preform cutting element comprising a cutting table that is bonded to a substrate of less hard material, such as cemented tungsten carbide. A front portion of the cutting table comprises a form of superhard material which is less wear-resistant than the superhard material forming the remainder of the cutting table. The provision of the less wear-resistant superhard material at the front cutting faces reduces the tendency of the cutting table to spall.

U.S. Pat. No. 5,238,074 discloses a cutter for a rotating drag bit which has a cutting face formed from a plurality of polycrystalline diamond (PCD) elements. The elements can be of varying thickness and/or varying hardness to provide a cutting edge having a non-uniform wear pattern. Also provided is a cutter which includes two layers of PCD elements. The PCD elements can be of varying thickness and/or hardness to provide a cutter which presents a cutting edge having a wear ratio which varies with cutter wear. Also provided is an impact cutter having a cutting surface formed from one or more layers of PCD elements.

U.S. Pat. No. 5,304,342 discloses a sintered product useful for abrasion- and impact-resistant tools and the like that comprises an iron-group metal binder and refractory metal carbide particles, e.g. tungsten carbide, formed in situ during sintering by the exothermic reaction of a carbide-forming refractory metal powder with a carbon source mixed therewith.

U.S. Pat. No. 5,370,195 discloses inserts for crushing rock having a cemented tungsten carbide body partially embedded in the drill bit and at least two layers at the protruding drilling portion of the insert. The outermost layer contains polycrystalline diamond and particles of carbide or carbonitride of elements selected from the group consisting of W, Ti, Ta, Cr, Mo, Cb, V, Hf and Zr. The remaining layers adjacent the polycrystalline diamond layer are transition layers each comprising a composite containing diamond crystals, particles of tungsten carbide, and particles of titanium carbonitride.

U.S. Pat. No. 5,370,717 describes a tool insert, which comprises an abrasive compact layer having a working surface and an opposite surface bonded to a cemented carbide substrate along an interface. At least one cemented carbide projection extends through the compact layer from the compact/substrate interface to the working surface in which it presents a matching surface.

U.S. Pat. No. 5,384,470 describes a rectifying contact that includes a refractory metal carbide layer on a polycrystalline diamond layer.

U.S. Pat. No. 5,468,268 discloses and claims a method of making an abrasive compact which includes the step of subjecting a mass of ultra-hard abrasive particles to conditions of elevated temperature and pressure suitable for producing an abrasive compact wherein at least 25 percent of the mass of ultra-hard abrasive particles consists of particles having at least three different average particle sizes within an average particle size range of 10 to 100 microns and at least 4 percent of the mass of ultra-hard abrasive particles have an average particle size of less than 10 microns.

U.S. Pat. No. 5,469,927 describes a preform cutting element, which comprises a thin cutting table of polycrystalline diamond, a substrate of cemented tungsten carbide, and a transition layer between the cutting table and the substrate. The interface between the cutting table and the transition layer is configured and non-planar to reduce the risk of spalling and delamination of the cutting table.

U.S. Pat. No. 5,505,748 discloses and claims a method of making an abrasive compact which includes the step of subjecting a mass of ultra-hard abrasive particles to conditions of elevated temperature and pressure suitable for producing an abrasive compact, wherein the mass of ultra-hard abrasive particles has an average particle size of less than 20 microns and consists of particles having at least a tri-modal particle size distribution.

U.S. Pat. No. 5,510,193 discloses metal carbide supported polycrystalline diamond (PCD) compact having improved shear strength and impact resistance properties, and a method for making the same under high temperature/high pressure (HT/HP) processing conditions. A sintered polycrystalline cubic boron nitrite (PCBN) compact interlayer is provided to be bonded at a first interface to a sintered PCD compact layer, and at a second interface to a cemented metal carbide support layer comprising particles of a metal carbide in a binder metal.

U.S. Pat. No. 5,645,617 discloses a compact for use in operations that require improved thermal stability, impact strength, and abrasion resistance. The compact includes a substrate formed of tungsten carbide or other hard material with multiple abrasive diamond crystal layers bonded to the substrate. The abrasive diamond crystals are provided in successive layers of different size particles with the coarsest size particles being farthest away from the substrate. A catalyst is premixed with the diamond crystals in a weight percent which progressively decreases from the layer closest to the substrate through succeeding layers.

U.S. Pat. No. 5,711,702 describes a cutting compact having a superhard abrasive layer bonded to a substrate layer, where the configuration of the interface between the abrasive and the substrate layers is non-planar, or three dimensional, to increase the surface area between the layers available for bonding.

U.S. Pat. No. 5,766,394 discloses and claims methods for forming diamond layers by use of diamond tape formed by shear compaction methods.

U.S. Pat. No. 5,855,996 discloses and claims a PCD compact wherein the diamond table has a mixture of submicron size particles ranging from 0.01 to 1 microns (2 to 15 weight percent) and large grain diamond having particle sizes ranging from about 6 to 100 microns.

U.S. Pat. No. 5,871,060 describes a manufacturing method and a drill bit including a composite insert for performing mechanical actions that require high wear and impact resistance.

U.S. Pat. Nos. 5,848,348 and 6,011,248 describe the fabrication of a highly wear resistant layer either directly upon an article or tool support structure or body, or as a wear resistant insert or element, which is subsequently attached to the tool body.

U.S. Pat. No. 5,890,552 describes superabrasive cutting elements for rolling cutter bits, and mounting techniques for such cutting elements.

U.S. Pat. No. 6,063,333 describes a process of making a two part drill bit insert, namely, a body portion of hard particles such as tungsten carbide particles mixed in an alloy binding the particles.

U.S. Pat. No. 6,068,913 discloses and claims a cutter comprising a substrate with a non-planar interface, a diamond table and an intermediate layer having a mixture of super hard material being at least 50% by volume and a bonding medium. The bonding medium is defined as at least one of the group consisting of a carbide, nitride, or a carbonitride of the IVb, Vb, VIb transition metals. The intermediate layer is for the purpose of limiting the migration of cobalt or other binders from infiltrating the diamond table.

U.S. Pat. No. 6,068,071 describes polycrystalline diamond cutter designs, which substantially improve the penetration rate of fixed cutter drill bits while simultaneously reducing the wear on the bit during drilling operations.

U.S. Pat. No. 6,098,731 discloses a polycrystalline diamond layer attached to a cemented metal carbide structure used as a cutter in a drill bit wherein the cutter has improved toughness or fracture resistance during use through the inclusion of boron.

U.S. Pat. No. 6,102,140 discloses an improved insert comprising a body having first and second portions and first and second zones. The first zone may consist of tungsten carbide and metallic cobalt, with preselected dimensions adapted for press fitting within a respective socket of the ground engaging tool. The second body portion may define an earth engaging portion. The second zone may consist of encrusted diamond pellets, tungsten carbide and metallic cobalt, fused together. The first and second zones may be fused together with the first zone being substantially free of encrusted diamond pellets.

U.S. Pat. No. 6,106,957 discloses and claims a super hard composite comprising a mixture of a super hard material being 40%-80% by volume percent and a matrix component selected from of nickel, iron, cobalt, molybdenum, tungsten, niobium, tantalum, vanadium and alloys thereof. The components are combined in a uniform mixture and pressed to at least 95% of theoretical maximum density.

U.S. Pat. No. 6,179,886 discloses a method for producing abrasive grains. The method is characterized by the steps of manufacturing a polycrystalline body comprising diamond particles in a matrix of silicon carbide and silicon, or alternatively metal-silicon-carbon or boron-silicon-carbon phases, and crushing the polycrystalline body into grains. The invention also relates to abrasive grains produced by the method.

U.S. Pat. No. 6,187,068 discloses a polycrystalline diamond compact for use in cutting operations that require improved impact strength and non-uniform edge wear. The compact includes a substrate, with multiple, laterally spaced, abrasive diamond particle areas segregated by different particle sizes bonded to the substrate. The polycrystalline diamond areas formed of finer size diamond particles provide higher abrasion resistance wear at a slower rate thus producing a non-linear cutting edge to the work zone.

U.S. Pat. No. 6,189,634 describes a PCD that includes polycrystalline diamond extending around the periphery of the compact to reduce the residual stresses inherent in thick diamond regions of cutters to increase the overall wear and durability.

U.S. Pat. No. 6,248,447 discloses a cutting element for a rotary drill bit including at least one insert of polycrystalline diamond of a kind incorporating a carbonate as a sintering binder-catalyst. The insert is mounted by being at least partly surrounded by a support body of conventional polycrystalline diamond of a kind incorporating a sintering binder-catalyst selected from cobalt and other iron group elements or alloys thereof. The insert and support body may be integrally bonded to a substrate during manufacture. Either the insert or support body may be pre-sintered or sintered during formation of the cutting element.

U.S. Pat. No. 6,319,460 discloses a metal-matrix diamond or cubic boron nitride composite and method of making the same. The metal-matrix/diamond composite includes grains of diamond uniformly distributed in a metal matrix. Alternatively, grains of cubic boron nitride may be used. Suitable metals for the metal matrix material may include nickel, cobalt, iron, and mixtures or alloys thereof. The metal-matrix/diamond or metal-matrix/cubic boron nitride composite has high fracture toughness due to its fine microstructure.

U.S. Pat. No. 6,325,165 discloses a cutting element having a cutting table made from sheet segments of commingled ultra hard material and binder. Each segment may be made from a finer or a coarser grade of ultra hard material or from different types of ultra hard material. The segments are aligned side by side over a cutting face of the cutting element to form the cutting table. The material grade and/or the material type of each segment may alternate across the cutting face.

U.S. Pat. No. 6,410,085 discloses a method of machining a polycrystalline diamond material including a matrix of interstices containing a catalyzing material and a volume close to a working surface thereof substantially free of catalyzing material which comprises the steps of treating the volume to render the polycrystalline diamond electrically conductive, and using an electron discharge machining technique to machine the polycrystalline diamond. In one embodiment, the treatment comprises applying a conductive material layer to a surface of the diamond.

U.S. Pat. Nos. 6,063,502, 6,361,873, 6,451,442, 6,454,027, and 6,607,835 disclose composite PCD cutters and a method for manufacture having a first structural phase formed from a hard material selected from the group consisting of cermet materials, polycrystalline diamond, polycrystalline cubic boron nitride, and mixtures thereof, and a second structural phase formed from a material that is relatively softer than that used to form the first structural phase. The composite construction includes repeated structural units that each comprise an ordered microstructure of first and second structural phases. PCD carbide composites of this invention display improved properties of fracture toughness and chipping resistance, without substantially compromising wear resistance, when compared to conventional pure PCD materials.

U.S. Pat. No. 6,454,077 discloses a polycrystalline diamond (PCD) carbide composite having a microstructure comprising a plurality of granules formed from PCD, polycrystalline cubic boron nitride, or mixture thereof, that are distributed within a substantially continuous second matrix region that substantially surrounds the granules and that is formed from a cermet material.

U.S. Pat. Nos. 6,544,308, 6,562,462, 6,585,064, 6,589,640, 6,592,985, and 6,601,662 disclose a polycrystalline diamond or diamond-like element with greatly improved wear resistance without loss of impact strength. These elements are formed with a binder-catalyzing material in a high-temperature, high-pressure (HTHP) process. The PCD element has a body with a plurality of bonded diamond or diamond-like crystals forming a continuous diamond matrix. Interstices among the diamond crystals form a continuous interstitial matrix containing a catalyzing material. The diamond matrix table is formed and integrally bonded with a metallic substrate containing the catalyzing material during the HTHP process. The diamond matrix body has a working surface, where a portion of the interstitial matrix in the body adjacent to the working surface is substantially free of the catalyzing material, and the remaining interstitial matrix contains the catalyzing material.

WIPO Patent Application No. WO 02/34437 discloses a cutter with at least three diamond layers. The layer at the interface has at least quad-modal diamond distribution, the outer layer having at least a tri-modal diamond distribution. The inner layer is generally coarser (up to 100 microns) than the outer layer (up to 25 microns.) The intermediate layer(s) will differ from the inner and outer layers.

SUMMARY OF INVENTION

Polycrystalline diamond (PCD) cutters are frequently used as the cutting structure on drill bits to bore through geological formations. It is not unusual that PCD cutters are subjected to conditions down hole that exceed the mechanical properties of the insert and failures occur. Two common types of failure are related to abrasion and impact resistance. In abrasive formations a PCD cutting edge will dull more rapidly as a function of the cutters" abrasion resistance. Fine grain diamond can be used to slow the rate of wear. However, following the traditional relationship between abrasion and impact resistance, the fine grained diamond cutter will likely fracture in high impact applications. The opposite holds true as well as a coarser grained diamond product will hold up well in high impact applications but will dull quickly in abrasive applications. This invention in its preferred embodiment provides a PCD cutter and a means for manufacture having high impact and abrasion resistance. It is desirable therefore, to provide a PCD cutter wherein high abrasion and high impact materials are joined together to form a high abrasion/high impact composite.

While PCD devices have been conventionally made using the sintered catalytic elements listed above in the background section, PCD devices can also be manufactured using non-conventional catalytic elements, including: phosphorous, carbonates (such as $LiCO_3$, $NaCO_3$, $MgCO_3$, $CaCO_3$, $SrCO_3$, and $K_2CO_3$; sulfates, including: $Na_2SO_4$, $MgSO_4$, — and $CaCO_4$; hydrates, including $Mg(OH)_2$, and $Ca(OH)_2$; $WO_3$; B, $B_4C$; $TiC_{0.6}$; Iron oxide or double oxide, including: $FeTiO_3$, $Fe_2SiO_4$, $Y_3Fe_5O_{12}$ and the like; copper, zirconium and germanium; and Buckminsterfullerenes. The use of many of these elements can produce a PCD product that is much more thermally stable than that of a conventional PCD. Historically, a significant disadvantage of the use of these non-conventional catalytic materials is that they have produced free-standing PCD discs that are not attached or easily attachable to a substrate. This present invention provides a technique for attaching PCD devices synthesized with non-conventional catalytic elements to a cemented tungsten carbide substrate, making such a substrate effective in PCD applications that require a substrate.

It is on objective of one present embodiment of this invention to provide a PCD cutter that does not follow the traditional tradeoff relationship between impact and abrasion resistance.

It is an objective of one present embodiment of this invention to improve the impact resistance of high abrasion PCD cutters.

It is an objective of one present embodiment of this invention to improve the abrasion resistance of high impact PCD cutters.

It is an objective of one present embodiment of this invention to take advantage of the impact resistance of coarse grains while maintaining abrasion resistance.

It is an objective of one present embodiment of this invention to improve the thermal stability of a traditional PCD cutter.

It is an objective of one present embodiment of this invention to improve the impact resistance of a thermally stable cutting element.

It is an objective of one present embodiment of this invention to produce a thermally stable product that is stable through the entire diamond layer thickness.

It is an objective of one present embodiment of this invention to produce a product with high impact/high abrasion and thermal stability throughout the diamond layer thickness.

It is an objective of one present embodiment of this invention to provide a thermally stable PCD cutter by using thermally stable PCD agglomerates instead of single crystal diamond grit particles.

It is an objective of one present embodiment of this invention to provide a method of manufacture for a high impact/high abrasion PCD cutter.

Additional objects, advantages and other novel features of this invention will be set forth in part in the description that follows and in part will become apparent to those skilled in the art upon examination of the following or may be learned with the practice of the invention. The objects and advantages of this invention may be realized and attained by means of the instrumentalities and combinations particularly pointed out in the appended claims. Some embodiments of the present invention include some, all or none of the above recited objects. Moreover, still other objects of the present invention will become readily apparent to those skilled in the art from the following description wherein there is shown and described several preferred embodiments of this invention, simply by way of illustration of modes of the invention suited to carry out this invention. As it will be realized, this invention is capable of other different embodiments, and its several details, and specific features are capable of modification in various aspects without departing from the invention. Accordingly, the objects, drawings and descriptions should be regarded as illustrative in nature and not as restrictive.

BRIEF DESCRIPTION OF DRAWINGS

The accompanying drawings incorporated in and forming a part of the specification, illustrate a preferred embodiment of the present invention. Some, although not all, alternative embodiments are described in the following description. In the drawings.

Reference will now be made in detail to the present preferred embodiment of the invention, an example of which is illustrated in the accompanying drawings.

DETAILED DESCRIPTION

This invention is intended, in its present embodiment, for use as a cutting structure on earth boring devices used in oil and gas exploration, drilling, mining, excavating and the like. PDC, Polycrystalline Diamond Cutters, are often used as the cutting structure on these earth boring devices. A common limitation of many prior PCD cutters is most often related to the level of abrasion resistance, impact resistance or thermal stability. The current invention in its numerous embodiments provides PCD cutters that improve the limitations of a typical PCD cutter. The current invention provides a PCD cutter with improved abrasion resistance, impact resistance and thermal stability including a method for manufacture thereof.

Figure 1:
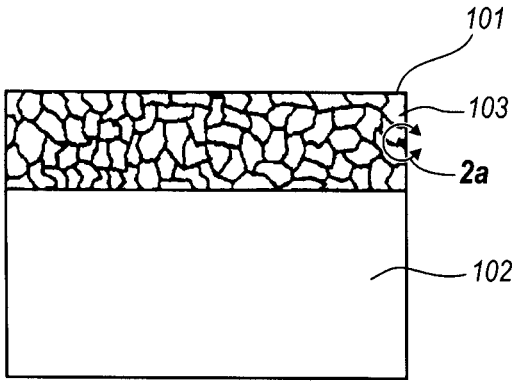
FIG. 1 illustrates a PCD cutter with preformed bodies sintered together to form an abrasive layer.

FIG. 1 depicts a PCD cutter of the current invention. The cutter comprises an abrasive layer 101 bonded to a substrate of a less hard material 102. The abrasive layer further includes preformed abrasive bodies 103 sintered together under high temperature/high pressure (HTHP) conditions.

Figure 2A:
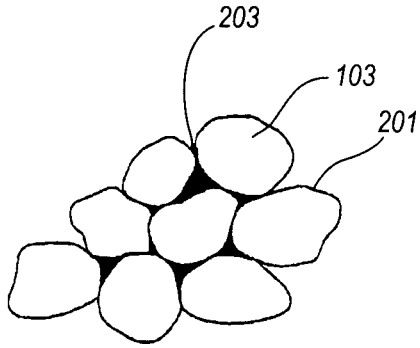
FIG. 2 illustrates a detailed view of the abrasive layer.
Figure 2B:
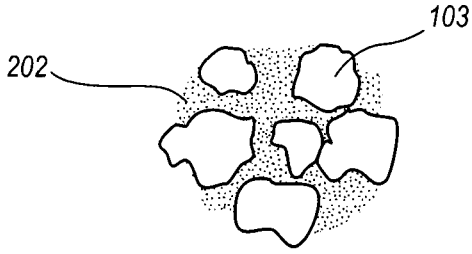

FIGS. 2*a* and 2*b* illustrate detailed views of the abrasive layer 101. The abrasive layer 101 includes one or more preformed abrasive bodies 103. In FIG. 2*a*, the preformed abrasive bodies 103 form a substantially continuous matrix 201. The substantially continuous matrix 201 is formed through HTHP sintering of the one or more preformed abrasive bodies 103. One or more interstices 203 are formed in the substantially continuous matrix 201. The interstices 203 contain material that differs from the substantially continuous matrix 201 in least one physical property. Such differing physical properties include, but are not necessarily limited to, one or more of hardness, thermal stability, grain size, abrasion resistance, and impact resistance. It is also possible that the interstices 203 can be substantially void of any material. FIG. 2*b* depicts another embodiment wherein the preformed abrasive bodies 103 are interspersed in a matrix 202. In this embodiment the preformed abrasive bodies 103 are sintered in a matrix 202 of material that differs from the preformed bodies in least one property. Typically, the differing properties include, but are not necessarily limited to, one or more of hardness, thermal stability, grain size, abrasion resistance, and impact resistance. In the preferred embodiment, the substantially continuous matrix 201 includes 30-100 micron preformed sintered polycrystalline diamond (PCD) bodies. The polycrystalline bodies are typically formed from pre-sintering diamond particles having an average grain size of less than 20 microns. In the present preferred embodiment, the interstices are substantially filled with residual catalytic metal from the sintering process. In alternative embodiments, the interstices are substantially filed with diamond, typically having a grain size less than 30 microns.

Figure 3:
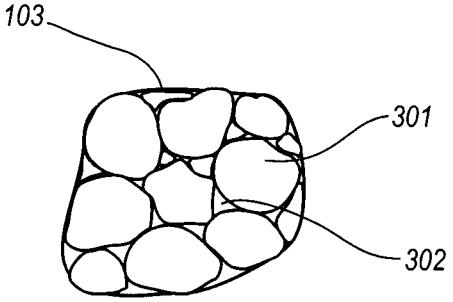
FIG. 3 depicts a detailed view of the preformed bodies.

FIG. 3 illustrates a detailed view of the preformed abrasive bodies 103. The preformed abrasive bodies are generally composed of a plurality of particles 301 formed into one body. Furthermore, the abrasive body 103 includes an number of interstices 302 formed between the particles 301. In the present preferred embodiment, the preformed abrasive body is made up of generally 12 micron diamond crystals pre-sintered to form a polycrystalline diamond body. The interstices 302 preferably would be substantially devoid of essentially all of the catalytic material in order to improve the thermal stability and abrasion resistance of the preformed abrasive body 103. The interstices 302 can, in some embodiments, include non-catalytic materials or can be substantially material free. In other embodiments, the interstices 302 may include catalytic material. In particular, the interstices 302 may include thermally stable catalytic material such as carbonates, sulfates, hydrates, phosphates and other similar non-metallic catalytic element materials.

The shape and size of preformed abrasive bodies 103 may vary. In the present preferred embodiment the size of the abrasive bodies 103 ranges from 30 100 micron. However, the abrasive layer 101 can also include preformed abrasive bodies 103 ranging from 10 microns to 0.500" inches. In the present preferred embodiment the shape of the preformed abrasive bodies 103 is a blocky shape with aspect ratios of less than 3. However, certain methods for preforming the abrasive bodies 103, specifically crushing pre-sintered material, can result in irregular shapes with aspect ratios greater than 3. Irregular random shapes with large or small aspect ratios would be considered within the scope of this invention. The shape of the preformed abrasive bodies 103, in some embodiments, can also include specific geometric shapes including cubes, pyramids, spheres, cylinders, conics, or variations thereof.

Figure 4:
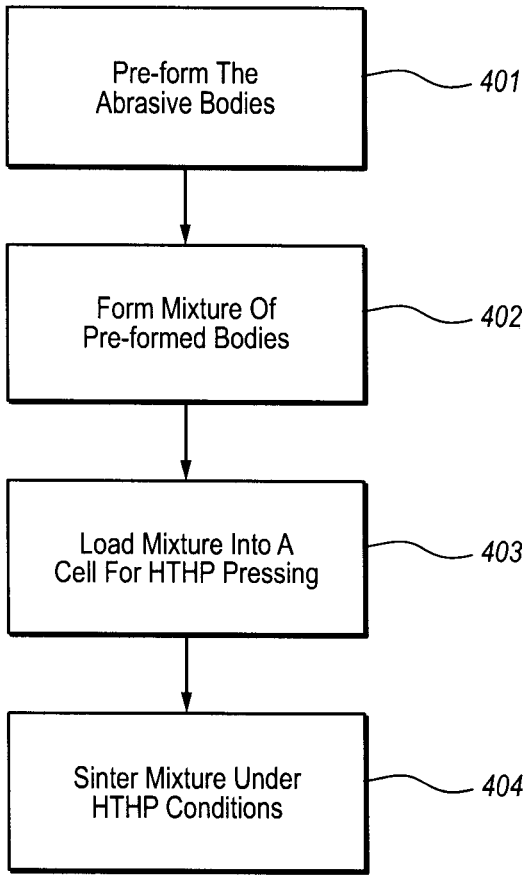
FIG. 4 depicts the process flow diagram for manufacturing a high impact/high abrasion PCD cutter.

FIG. 4 illustrates a method for manufacturing a high impact/high abrasion cutter. The process includes preforming 401 the abrasive bodies, forming 402 a mixture of preformed bodies, loading 403 the mixture into a cell for pressing and sintering 404 the mixture under HTHP conditions required for diamond to diamond bonding to occur. The abrasive bodies are presently preformed 401 under HTHP conditions. The preformed bodies are typically formed into specific shapes and sizes in the HTHP press or preferably are formed as a slug followed by a crushing process creating small abrasive bodies. The smaller abrasive bodies can be crushed through a number of mirconizing processes and tools including a ball mill. In the present preferred embodiment the pre-forming step 401 further includes acid treating the abrasive bodies before or after the crushing process to remove any residual catalytic material present from the HTHP sintering process. In alternative embodiments, this process can also include back filling the slug or abrasive bodies with non-catalytic material to improve the thermal stability of the abrasive bodies.

A mixture is then formed 402 from the pre-formed abrasive bodies. The mixture typically includes compositions of materials that may have differ material properties including hardness, thermal stability, grain size, abrasion resistance, and impact resistance. In one possible envisioned embodiment, this process includes mixing acid treated thermally stable polycrystalline diamond bodies with monocrystalline diamond. Another embodiment includes polycrystalline diamond bodies interspersed in a tungsten carbide powder. The mixture can also include a variety of preformed body sizes that follow a single or multi-modal distribution. The present preferred mixture typically includes a number of preformed bodies in various shapes, sizes, materials, material properties or combinations thereof.

The mixture formed 402 from the preformed abrasive bodies is loaded 403 into a cell for pressing under HTHP conditions. During this step the cell is loaded into a HTHP press and subjected to pressures and temperatures required for diamond to diamond bonding to occur.

In alternative embodiments of the invention, a combination of one or more of the features of the foregoing PCD devices should be considered within the scope of this invention. The appended claims are to define the scope of this invention. All process and devices that come within the meaning and range of equivalency of the claims are to be embraced as being within the scope of this patent.

The invention claimed is:

1. A polycrystalline diamond compact, comprising:

a substrate;

an abrasive layer bonded to said substrate, the abrasive layer comprising a sintered volume of material including a plurality of preformed polycrystalline abrasive bodies having a plurality of interstitial areas located within each of the plurality of abrasive bodies, the abrasive layer further including a plurality of interstitial spaces located between the plurality of preformed abrasive bodies;

wherein each polycrystalline preformed abrasive body comprises a plurality of abrasive particles and a non-metallic material within the plurality of interstitial areas located within the abrasive body and wherein at least some of the interstitial spaces located between the plurality of abrasive bodies contain a catalytic metal material.

2. A polycrystalline diamond compact as recited in claim 1 wherein said plurality of abrasive particles comprises a plurality of polycrystalline diamond particles.

3. A polycrystalline diamond compact as recited in claim 1 wherein at least some of the interstitial areas located within said plurality of preformed polycrystalline abrasive bodies are infiltrated with a non-catalytic material.

4. A polycrystalline diamond compact as recited in claim 1 wherein said preformed polycrystalline abrasive bodies further comprise polycrystalline cubic boron nitride.

5. A polycrystalline diamond compact as recited in claim 1 wherein an average size of said preformed polycrystalline abrasive bodies is less about 100 microns or less.

6. The polycrystalline diamond compact of claim 1, wherein the plurality of preformed polycrystalline abrasive bodies are sintered to one another to form a substantially continuous matrix and defining the plurality of interstitial spaces between the abrasive bodies.

7. A polycrystalline diamond compact as recited in claim 1 wherein the sintered volume of material includes a substantially continuous matrix and wherein said preformed polycrystalline abrasive bodies are dispersed and spaced apart throughout the substantially continuous matrix.

8. A polycrystalline diamond compact as recited in claim 7 wherein said substantially continuous matrix is selected from the group consisting of diamond, cubic boron nitride, carbide and group IV, V, and VI transition metals of the periodic table.

9. A polycrystalline diamond compact as recited in claim 7 wherein said substantially continuous matrix and said preformed polycrystalline abrasive bodies comprise diamond.

10. A polycrystalline diamond compact as recited in claim 7 wherein said substantially continuous matrix comprises carbide and said preformed polycrystalline abrasive bodies comprise diamond.

11. A polycrystalline diamond compact as recited in claim 1, wherein the interstitial areas within the abrasive bodies contain at least one of the group consisting of a carbonate, a sulfate, a hydrate and a phosphate.

12. A polycrystalline diamond compact as recited in claim 1, wherein the superabrasive particles exhibit an average grain size of less than about 20 microns.

13. The polycrystalline diamond compact of claim 1 wherein the plurality of preformed polycrystalline diamond volumes exhibit an average size of between about 10 microns and about 0.5 inches.

14. A polycrystalline diamond compact as recited in claim 1 wherein each of said preformed polycrystalline abrasive bodies further comprises a plurality of diamond crystals having an average grain size of less than 40 microns.

15. A polycrystalline diamond compact as recited in claim 1 wherein each of said preformed polycrystalline abrasive bodies exhibits a blocky shape with an aspect ratio of less than 3.

16. A polycrystalline diamond compact as recited in claim 1 wherein at least some of the preformed polycrystalline abrasive bodies exhibit a geometry having an aspect ratio of greater than 3.

17. A polycrystalline diamond compact as recited in claim 1 wherein the preformed polycrystalline abrasive bodies exhibit spherical geometries.

18. A polycrystalline diamond compact as recited in claim 1 wherein the preformed polycrystalline bodies exhibit geometries from the group consisting of cubes, pyramids, cylinders and conics.

19. A polycrystalline diamond compact as recited in claim 1 wherein the plurality of preformed polycrystalline abrasive bodies each exhibit substantially the same size.

20. A polycrystalline diamond compact as recited in claim 1 wherein the plurality of preformed polycrystalline abrasive bodies exhibit various sizes.

21. A polycrystalline diamond compact, as recited in claim 1, wherein the catalytic metal material comprises tungsten carbide.

22. A polycrystalline diamond compact, as recited in claim 1, wherein the catalytic metal material comprises at least one of the group consisting of cobalt, iron and nickel.

* * * * *